US008869781B2

(12) United States Patent
Jones

(10) Patent No.: US 8,869,781 B2
(45) Date of Patent: Oct. 28, 2014

(54) ARCHERY RELEASE

(75) Inventor: Brian K. Jones, Winchester, KY (US)

(73) Assignee: Scott Archery LLC, Henrietta, NY (US)

( * ) Notice: Subject to any disclaimer, the term of this patent is extended or adjusted under 35 U.S.C. 154(b) by 610 days.

(21) Appl. No.: 13/190,581

(22) Filed: Jul. 26, 2011

(65) Prior Publication Data

US 2013/0025578 A1 Jan. 31, 2013

(51) Int. Cl.
*F41B 5/18* (2006.01)
*F41B 5/14* (2006.01)

(52) U.S. Cl.
CPC ..... *F41B 5/1469* (2013.01)
USPC ..... 124/35.2; 124/90

(58) Field of Classification Search
CPC ..... F41B 5/1469
USPC ..... 124/35.2, 90
See application file for complete search history.

(56) References Cited

U.S. PATENT DOCUMENTS 228,302 A * 6/1880 Beard ..... 124/35.2
229,089 A * 6/1880 Burnham ..... 124/35.2
3,853,111 A * 12/1974 Stanislawski et al. ..... 124/35.2
3,965,884 A * 6/1976 Killian ..... 124/35.2
4,036,204 A * 7/1977 Scott ..... 124/35.2
4,041,926 A * 8/1977 Troncoso et al. ..... 124/35.2
4,160,437 A * 7/1979 Fletcher ..... 124/35.2
4,509,497 A * 4/1985 Garvison ..... 124/35.2
4,539,968 A * 9/1985 Garvison ..... 124/35.2
4,567,875 A * 2/1986 Fletcher ..... 124/35.2
4,574,767 A * 3/1986 Gazzara ..... 124/35.2
4,620,523 A * 11/1986 Peck ..... 124/35.2
4,674,469 A * 6/1987 Peck ..... 124/35.2
4,854,293 A * 8/1989 Roberts ..... 124/35.2
4,881,516 A * 11/1989 Peck ..... 124/35.2
5,009,214 A * 4/1991 Wilde ..... 124/35.2
5,025,772 A * 6/1991 Stevenson ..... 124/35.2
5,205,268 A * 4/1993 Savage ..... 124/24.1
5,261,581 A * 11/1993 Harden, Sr. ..... 224/219
5,273,021 A * 12/1993 Tepper ..... 124/35.2
5,323,754 A * 6/1994 Pittman et al. ..... 124/35.2
5,448,983 A * 9/1995 Scott ..... 124/35.2
5,546,924 A * 8/1996 Todd ..... 124/35.2
5,595,167 A * 1/1997 Scott ..... 124/35.2
5,596,977 A 1/1997 Scott (Continued)

OTHER PUBLICATIONS

Various prior art releases (1) downloaded from http://www.archeryhistory.com/releases/releasespics/pse.jpg on Dec. 29, 2009.

(Continued)

*Primary Examiner* — Gene Kim
*Assistant Examiner* — Alexander Niconovich
(74) *Attorney, Agent, or Firm* — Hiscock & Barclay, LLP

(57) ABSTRACT

A hybrid archery release including a release body pivotally joined with a roller defining a roller axis, a wrist strap, and a flexible tether extending between and joining the roller and the wrist strap. The release body can be a back tension release body and can have a body including a handle, and the release body can selectively rotate about the roller axis when the handle is engaged by an archer so that the release releases a bowstring held thereby upon such selective rotation. The release also can be configured to remain in a cocked mode as the release is used to draw a bowstring. A method also is provided for drawing and releasing a bowstring with the assistance of the hybrid release.

18 Claims, 7 Drawing Sheets

(56) References Cited

U.S. PATENT DOCUMENTS

| | | | | | |
|---|---|---|---|---|---|
| 5,685,286 | A * | 11/1997 | Summers | 124/35.2 |
| 5,694,915 | A * | 12/1997 | Summers | 124/35.2 |
| 5,765,536 | A * | 6/1998 | Scott | 124/35.2 |
| 5,803,068 | A * | 9/1998 | Summers | 124/35.2 |
| 5,850,825 | A * | 12/1998 | Scott | 124/35.2 |
| 5,937,842 | A * | 8/1999 | Summers et al. | 124/35.2 |
| 6,032,661 | A * | 3/2000 | Goff et al. | 124/35.2 |
| 6,571,786 | B2 * | 6/2003 | Summers et al. | 124/35.2 |
| 6,631,709 | B2 * | 10/2003 | Carter et al. | 124/35.2 |
| 6,736,124 | B2 * | 5/2004 | Carter | 124/35.2 |
| 6,895,951 | B2 * | 5/2005 | Summers et al. | 124/35.2 |
| 6,945,241 | B2 * | 9/2005 | Pellerite | 124/35.2 |
| 6,953,035 | B1 * | 10/2005 | Summers et al. | 124/35.2 |
| 7,654,254 | B1 * | 2/2010 | Rentz et al. | 124/35.2 |
| 8,622,051 | B2 * | 1/2014 | Summers et al. | 124/35.2 |
| 2004/0079351 | A1 * | 4/2004 | Summers et al. | 124/35.2 |
| 2009/0090342 | A1 * | 4/2009 | Freitag et al. | 124/35.2 |
| 2009/0095270 | A1 * | 4/2009 | Graves | 124/35.2 |
| 2010/0108047 | A1 * | 5/2010 | Jones | 124/35.2 |
| 2011/0168146 | A1 * | 7/2011 | Deceuster | 124/35.2 |
| 2012/0192844 | A1 * | 8/2012 | Springer | 124/35.2 |
| 2012/0285431 | A1 * | 11/2012 | Summers et al. | 124/35.2 |

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

* cited by examiner

ARCHERY RELEASE

BACKGROUND OF THE INVENTION

The present invention relates to releases for holding and releasing bowstrings, and more particularly, to back tension archery releases.

Conventional archery releases are designed to temporarily hold a bowstring of an archery bow so that an archer can pull on the release and subsequently draw the bowstring with the release. In general, such releases assist an archer in cleanly and consistently releasing the bowstring when the archer shoots an arrow from the bow, and thus increase the accuracy of the archer's shot.

There are a variety of archery releases available. One common release is a strapped trigger release, and another is a back tension release. A strapped trigger release typically includes a release body having a trigger mechanism and one or more moveable jaws joined with the trigger mechanism. The body is joined with a strap that fits around an archer's wrist to securely anchor the release to the archer. The moveable jaws are configured to hold a bowstring of a bow. When activated by the archer's digits, the trigger mechanism moves the moveable jaws to release the bowstring and thereby shoot the bow. Due to ease of use, direct attachment to the archer via the strap (which reduces the likelihood of loss or misplacement of the release) and general reliability, strapped trigger releases are typically the preferred release used by bow hunters in the field.

A back tension release typically includes a release handle, a release head bracket pivotally secured to the handle, and a hook pivotally secured to the release head bracket. The hook is configured to hold the bowstring, and is also adapted to engage a pawl. To operate the release so that it releases a bowstring held in the hook, an archer holds the handle, and concentrates to squeeze together their shoulder blades, or in other words, "tense their back." Because the archer holds the device in their hand by the handle, tensing of the back muscles moves the hand, and in turn, rotates the release slightly. This slight rotation moves the release enough so that the hook disengages the pawl, and thereby becomes free to move and release the bowstring.

Back tension releases are highly effective at eliminating shot anticipation (which may hinder shot accuracy) because they release the bowstring somewhat unexpectedly. In general, this typically improves shooting form and shot placement and thereby increases the accuracy of an archer using the back tension release. For this reason, such releases are typically preferred by target shooting archers, where accuracy and precision are paramount. Such back tension releases, however, are usually difficult to keep track of due to their small size, and are generally difficult to learn how to use properly, given that their actuation is dependent on controlled contraction of infrequently used back muscles.

Many archers, who are both bow hunters and archery target shooters, switch back and forth from a strapped trigger release while bow hunting, to a back tension release while shooting for extreme accuracy and precision in target archery. Moreover, many bow hunters who have only used a strapped trigger release are usually hesitant to convert to a back tension release for hunting, or for target shooting for that matter, due to the complexities in training their muscles to operate the back tension release.

SUMMARY OF THE INVENTION

A hybrid archery release is provided including a release body, a pivoting roller joined with the release body, and a tether joining the pivoting roller with a wrist strap. The release body is effectively tethered to the wrist strap.

In one embodiment, the hybrid archery release is a hybrid back tension archery release. The release body can be a back tension release body. The pivoting roller and the tether can be spatially oriented to enable an archer to draw a bowstring of an archery bow with the back tension release, pulling via the attached the wrist strap, without the release unintentionally releasing the bowstring. The release remains in a cocked mode as the bowstring is drawn.

In another embodiment, the release body can include a handle, and the release body can selectively rotate about the roller axis when the handle is engaged by an archer so that the release releases a drawn bowstring upon such selective rotation.

In still another embodiment, the release defines a tether force axis and a bowstring force axis. The tether force axis is offset laterally from or aligned with the bowstring force axis when a bowstring is drawn with the release, so that the respective tether force and bowstring force cooperate to retain the release in a cocked mode as the bowstring is drawn.

The release described herein is an efficient hybrid release that combines a handheld release, for example, a back tension release, with a wrist strap. The release enables young and or less experiences archers, who are hesitant to use a handheld or back tension release, to do so with relative ease. It also can facilitate the transition between a conventional strapped release to a back tension release, which typically is difficult for many archers and bow hunters.

These and other objects, advantages and features of the invention will be more readily understood and appreciated by reference to the detailed description of the invention and the drawings.

DETAILED DESCRIPTION OF THE PREFERRED EMBODIMENT

I. Overview

Figure 1:
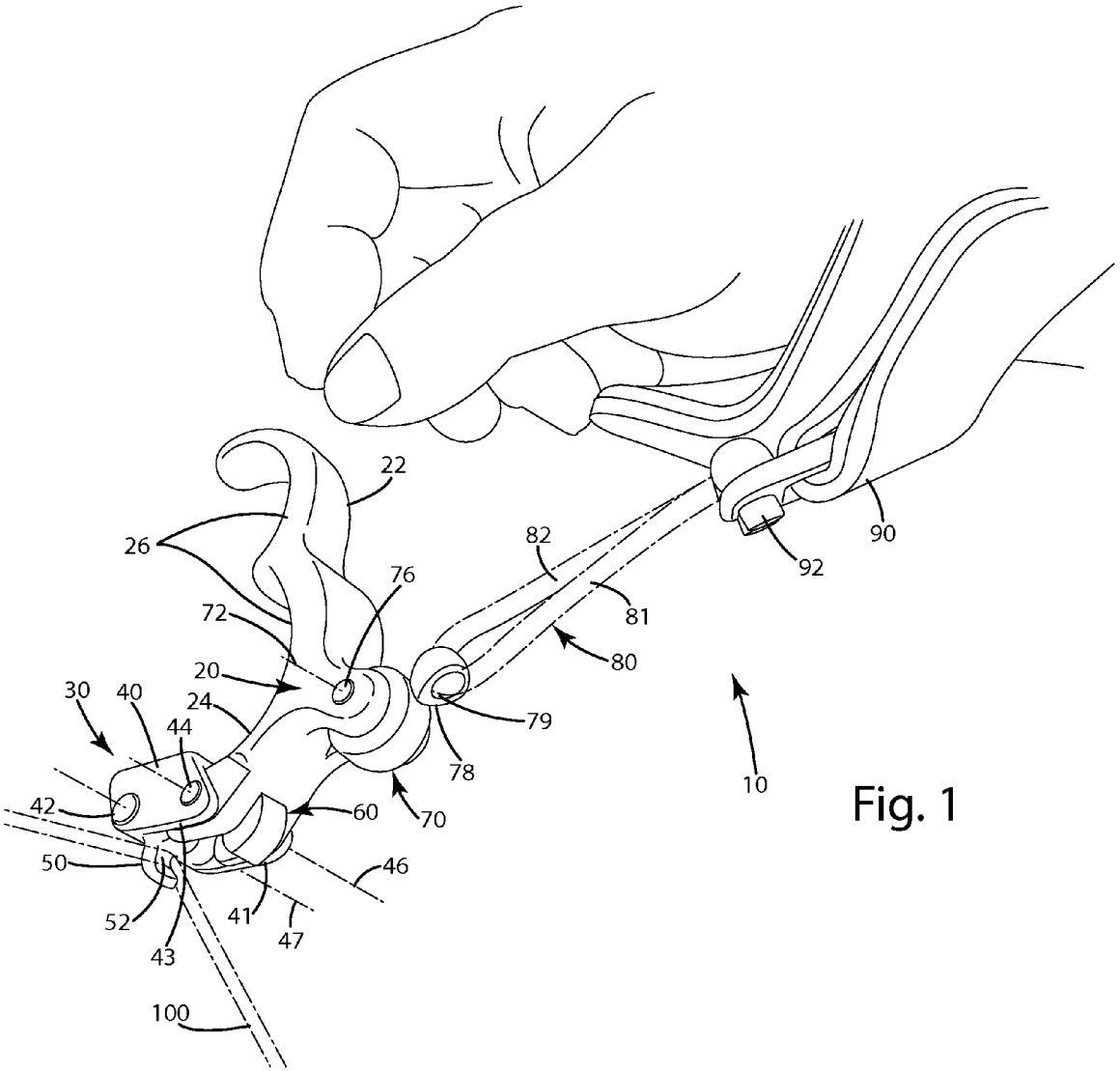
FIG. 1 is a perspective view of a current embodiment of the release in a cocked mode drawing a bowstring of an archery bow.

A release according to the current embodiment is shown in FIGS. 1-6 and generally designated 10. The release 10 illustrated is in the form of a hybrid back tension release; however, the current embodiment can be utilized with a variety of different types of releases, for example, plunger releases, thumb releases, pinky releases, rope releases, and other types of handheld releases modified as described herein to be tethered to a wrist strap with some type of roller as described herein.

The hybrid back tension release 10 shown in the figures includes a release body 20 joined with a release head 30, which can include an optional release bracket 40, a sear 50 and pawl 60. The release body 20, and generally the release 10, can be joined with a roller 70 to which a tether 80 is joined. The tether 80 can extend from the roller 70 to a wrist strap 90, which can then be secured directly to a wrist, arm or other appendage of a user.

Generally, the release body 20, roller 70, head 30 and tether 80 are aligned so that a bowstring 100, engaged by the sear 50, exerts a bowstring force 103 along a bowstring force axis 104. This bowstring force axis can be laterally offset and/or generally can balance a tether force 83 that is exerted by the tether 80 on the release along a tether force axis 84 as the release is used to draw a bowstring. In turn, this enables an archer to confidently draw the bowstring without the sear 50 disengaging the bowstring 100 and shooting the bow unintentionally. When drawn, this configuration also enables the release 10 to remain in a fully cocked mode until the release handle 22 or other actuator is depressed or generally moved, optionally toward the wrist strap 90. When such movement occurs, the release body 20 rotates about the roller pin axis 72 and causes the sear engagement edge 54 to move relative to the pawl engagement surface 66 until the sear engagement edge 54 disengages the same. Upon such a disengagement, the sear 50 is free to rotate, and thus release the bowstring 100 from the bowstring notch 52 of the sear, thereby shooting the bow with which the release is used.

Although shown as a bowstring 100, the term "bowstring" as used herein refers to an actual bowstring, a flexible or rigid D-loop or a nock generally attached to a bowstring, or some other element joined with the bowstring to which a release can be attached.

II. Construction

The components and structure of the hybrid archery release 10 will now be described in more detail. As mentioned above, the release 10 as illustrated is a hybrid back tension release. The release 10 can include a release body 20, which can include a handle 22. The handle can define multiple grooves or recesses 26 designed to accommodate one or more digits of a user. Alternatively, the handle can be a straight bar or other suitable gripping structure to enable a user to grasp the release body 20.

The handle can be configured so that it extends laterally on one side of the tether force axis 84, for example, on the first lateral side 89 of the tether force axis 84 when considered from the view point of a right-handed archer drawing the bowstring 100. Optionally, the handle and body can further be configured so that there is no portion of the handle, and more particularly, no finger grooves or other gripping elements disposed laterally, for example, on a second opposing lateral side 87 of the tether force axis 84. Such a construction can be included in the current embodiment of the release due to the geometry and relationship of the bowstring force axis 104 relative to the tether force axis and vice versa, and due to the corresponding balance of the respective forces 83, 103 via the arrangement of the release components.

Figure 3:
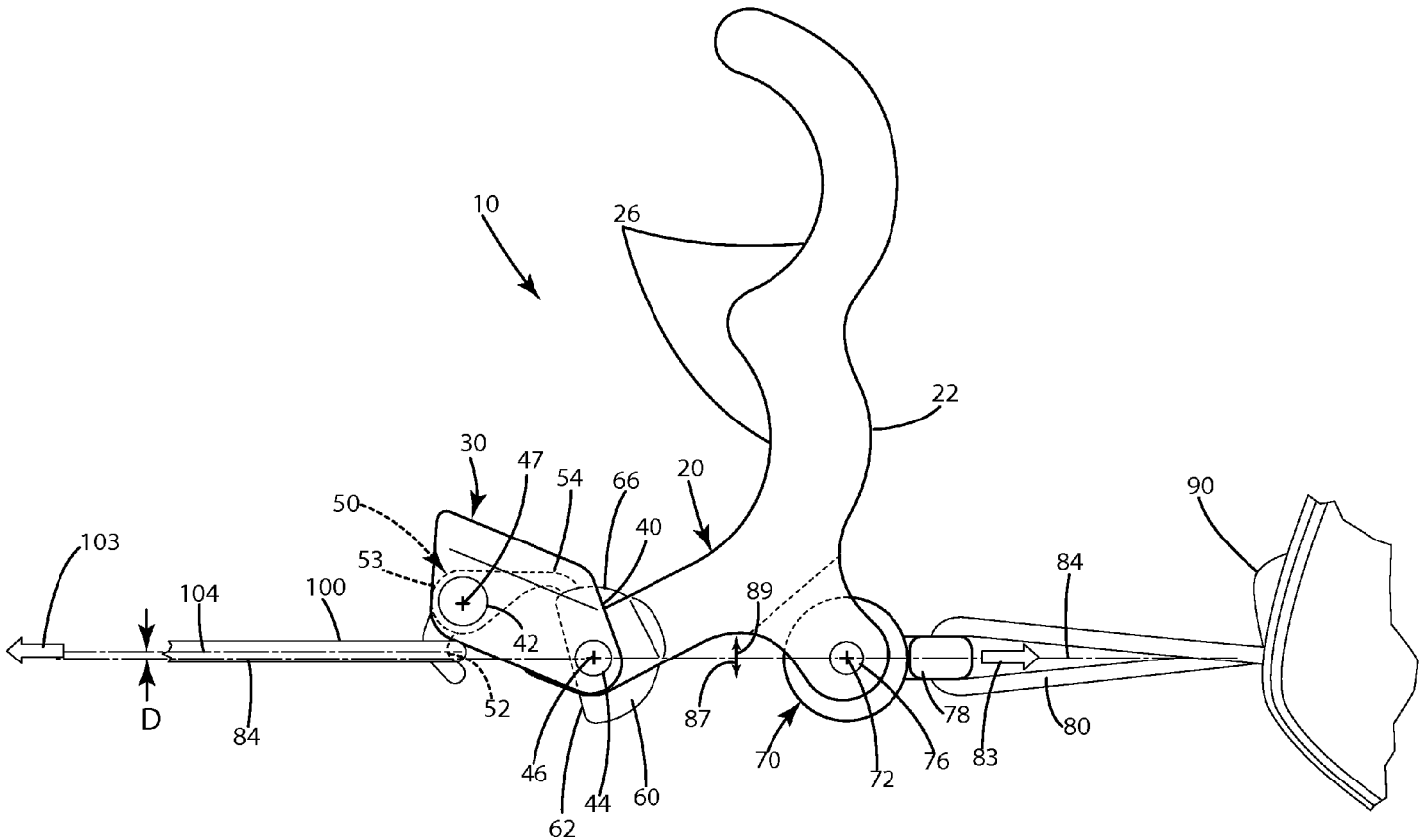
FIG. 3 is a top view thereof.

For example, as shown in FIG. 3, the release can define a tether force axis 84 along which the tether force 83 generally projects, as further described below. The handle 22 can include at least one finger recess 26 located on a first lateral side 89 of the tether force axis 84. As mentioned, the handle 22 can be constructed so that there are no digit recesses, grooves, or other handle-like elements, located on the second opposing lateral side 87 of the axis of the tether force axis 84. With the geometric configuration of the release 10, such recesses are optional, as there is no need to exert a force with a digit on the second opposing lateral side 87 of the axis to maintain the release in a cocked mode, as described below.

Generally, the release body 20 is rotatable about the roller axis 72 of the roller 70 and/or vice versa. The release body 20 can include an arm 24 extending toward the release head 30. The arm 24 can be an integral or separate from the handle and remainder of the body 20. If desired, the head 30 can also include a pivoting member (not shown) so that the head 30 can freely rotate relative to the body 20 and/or handle 2.

The release head 30 can include a release bracket 40. This release bracket 40 can generally be in the form of a channel-shaped member, including opposing sidewalls 41 and 43. These sidewalls can generally straddle an end of the release arm 24 and/or release body 20. The release bracket 40 can be secured via a pawl axle or pin 44, and can freely rotate about the pawl axle 44, for example, about a pawl axis 46. At the opposite end of the release bracket 40, a sear axle or pin 42 can be located. A sear 50 can be rotatably mounted to a sear axle or pin 42 so that the sear 50 can rotate about the sear axis 47. The sear 50 itself can be spaced from the sidewalls 41 and 43 via spacers or some other elements so that the sear 50 is generally aligned with the pawl 60.

The sear 50 can be constructed to define a bowstring notch 52 which directly engages the bowstring of an archery bow. This bowstring notch 52 can transition to a sear body 53. The sear body 53 can define a hole (not shown) through which the sear axle 42 fits so that the sear can rotate about the sear axis 47. The sear 50 can also include a sear engagement edge 54 which can be in the form of a polished or extremely smooth surface that is adapted to selectively engage the pawl engagement surface 66, which itself can be polished or extremely smooth. If desired, the sear 50 can be selectively tensioned or biased to a preselected configuration with a rubber band or other biasing element (not shown).

The pawl 60 can be attached to the arm 24 and the release body 20. As shown, the pawl 60 is in the form of a partial moon pawl including a rounded pawl engagement surface 66 and a chordal planar surface 62. Optionally, the pawl can be in the form of a truncated or D-shaped disc.

The pawl 60 can be mounted to the arm 24 in a preselected configuration according to the preference and sensitivity of the release to the archer. Depending on the precise placement of the rounded surface and the chordal planar surface 62, the sear engagement edge 54 can engage and disengage the pawl engagement surface 66, thereby allowing the sear 50 to freely rotate about the sear axis 47, and thereby release the bowstring 100 from the bowstring notch as described in further detail below. Optionally, the pawl 60 can be adjustable so that the precise degree of rotation of the chordal planar surface 62 can be adjusted via a set screw (not shown) that protrudes through the arm or body 20 of the release 10. In turn, this can enable an archer to adjust the sensitivity of the release to their preference.

Returning to FIGS. 1-3, the release body 20 also can be joined with a roller 70. The roller 70 can be in the form of a circular rounded disc that is generally rotatable about an axis 72 and joined with the body 20 via an axle or pin 76. The body 20 can define a recess or groove 27 within which the roller 70 is mounted. The recess 27 can be bounded by first and second support arms 28 and 29 which can be disposed on opposite sides of the roller 70. The support arms can be spaced from one another about the same width as the roller 70 so that roller can freely rotate relative to the axis 72, or put another way, the body 20 can rotate relative to the roller axis 72 when the release 20 is in a cocked and/or firing mode as described below.

The roller 70 can be rotatable about the axle 76 and more generally around the roller axis 72. Of course, if desired, the configuration can be reversed so that the axle 76 and roller 70 are an integral unit and the axle 76 rotates relative to one or both of the support arms 28 and 29, depending on the application. Moreover, although shown as including a forked configuration with support arms on opposite sides of the roller 70, one of the roller support arms 28 or 29 can be removed depending on the application.

The roller 70 as shown is generally in the form of a rounded or circular disc, however, it can take on other geometric configurations. For example, it can be elliptical, rectangular, square, triangular, polygonal, hexagonal or of some other geometric shape. Whatever the geometric configuration, the roller 70 and release body 20 generally can be rotatable relative to one another about the roller axis 72 or some other axis.

Figure 2:
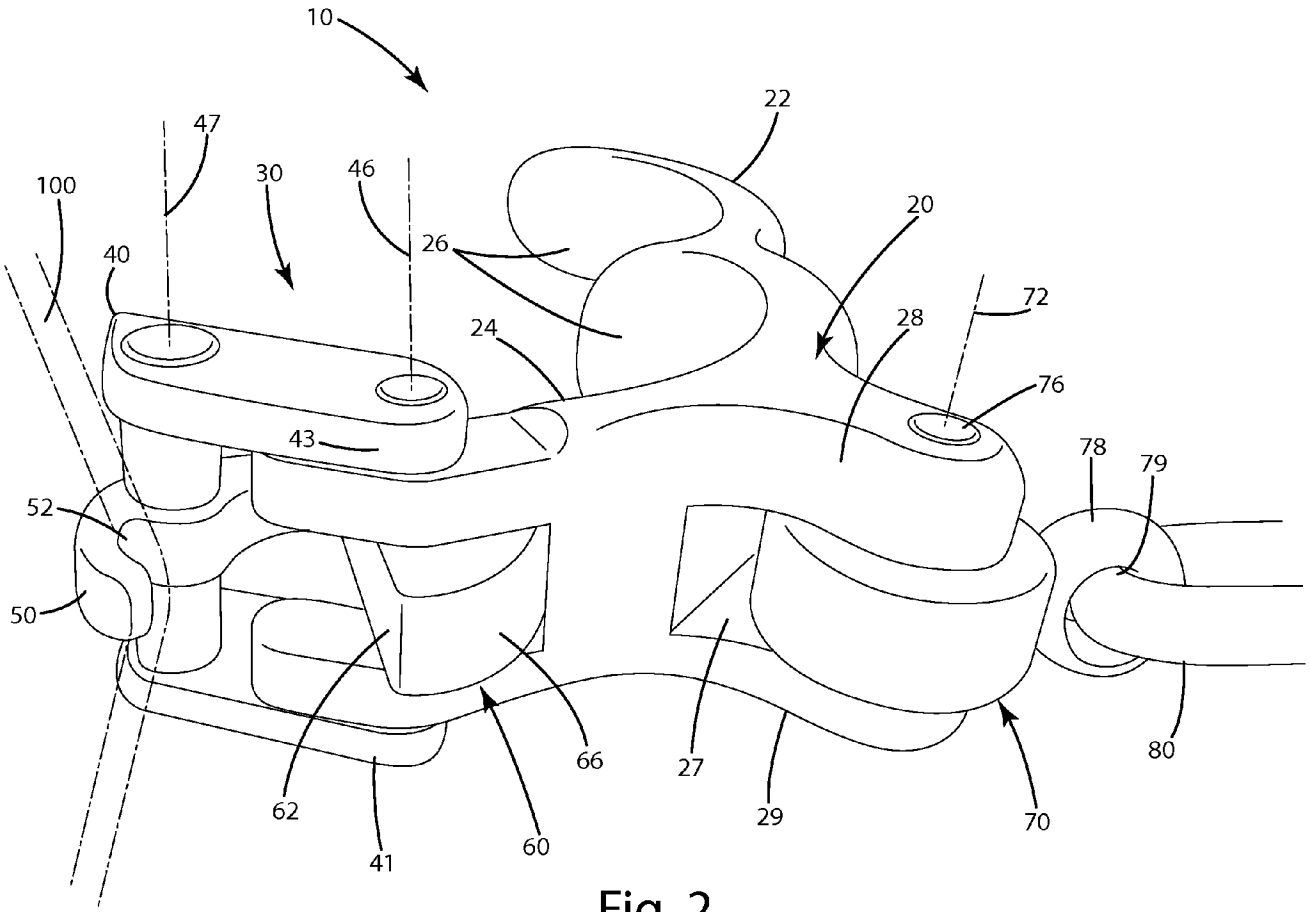
FIG. 2 is a side perspective view thereof.

The roller 70 can include an attachment element 78. As shown in FIGS. 2-3, the attachment element 78 can be in the form of a loop or circular element that defines an aperture or hole 79 therethrough. The hole 79 can be configured to accommodate at least a portion of the tether 80. The tether can be threaded through the aperture 79, and thus the attachment element 78, and can include first 81 and second 82 tether portions. These first and second tether portions 81 and 82 can extend rearwardly back toward to the strap 90.

The tether 80 as illustrated can be generally flexible, that is, it can flex and/or bend relatively easily to enable the orientation of the release body 20 to be altered relative to the wrist strap 90, and/or to provide a simple attachment to the release body. Optionally, although the tether is illustrated in the form of a cord, it can also be in the form of a strap, a wire, a rigid rod or some other connector. Such a connector can also be adjustable to enable the distance between the release body 20 and the wrist strap 90 to be varied and thereby accommodate the personal preferences and/or physical anatomy of an archer. One example of an adjustable connector suitable for use as a tether is disclosed in U.S. Pat. No. 5,850,825 to Scott, which is hereby incorporated by reference.

The strap 90 can include a fastening and/or adjustment element 92 that attaches the tether 80 to the strap 90. Of course, the precise attachment and exact construction used to attach the tether 80 to the strap 90 can vary as desired. The wrist strap 90 can be in the form of a buckle or velcro strap including opposing ends that generally close around an appendage, for example, a wrist, hand or forearm of an archer to secure the wrist strap 90 directly to the appendage. Optionally, the wrist strap can take the configuration of U.S. Pat. No. 5,595,167 to Scott, which is hereby incorporated by reference. Of course, if buckle straps or alternative straps are desired, those can be used as well.

Figure 4:
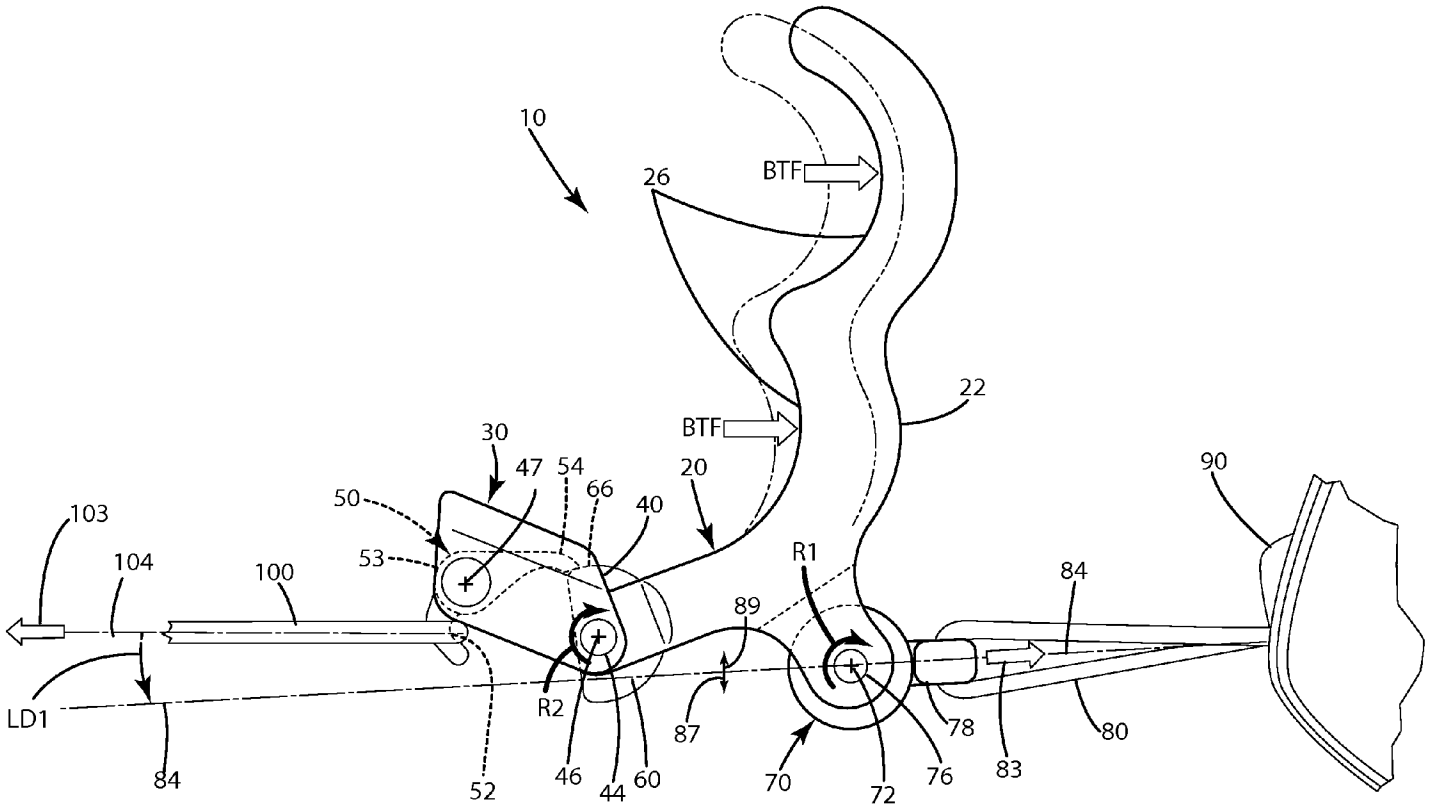
FIG. 4 is a top view of the release transitioning from a cocked mode to a firing mode.

As mentioned above, the release 10 can define a bowstring force axis 104 and a tether force axis 84. Generally, these axes correspond to the axes along which the bow force 103 and the tether force 83 are exerted by the respective bowstring 100 and the tether 80, the tether being further attached to the wrist strap 90 as noted above. The bowstring force 103 generally coincides with the forces stored in the archery bow to which the bowstring 100 is attached. The forces in the tether 80 correspond to the forces exerted by a user's appendage attached to the wrist strap 90. Generally, when drawing an archery bow, the exerted tether force 83 is greater than the bowstring force 103 stored in the bow so that the bow can be drawn to a fully drawn mode. When the bowstring is fully drawn as shown in FIGS. 3-4, the bowstring force 103 is generally equal to the tether force 83, so that the bowstring 100 is held in a static position, with the bow being fully drawn.

Referring to FIG. 3, the release 10 is configured so that the bowstring force axis 103 along which bowstring force is projected, and the tether force axis 84, along which the tether force 83 is projected, are at least one of laterally offset from one another and/or balanced and/or aligned so that when the bowstring is being drawn, or when it is fully drawn, as shown in FIG. 3, these forces counteract one another, so that the release remains in the fully cocked mode as shown in FIG. 3. In the cocked mode, the bowstring 100 is retained in the bowstring notch 52 of the sear 50 and the sear engagement edge 54 satisfactorily engages the pawl engagement surface 66 so that the bowstring is not released by the release 10. In the cocked mode, the release is generally unable to release the bowstring 100 from the bowstring notch 52. The holding of the release 10 in the cocked mode occurs "automatically" as the release is used to initially draw the bowstring, provided the sear engagement edge 54 is in engagement with the pawl engagement surface 66 when that initial drawing of the bowstring 100 occurs.

As shown in FIG. 3, in this cocked mode of the release, the pawl axis 44 and the roller pin axis 72 are generally aligned with one another along the tether force axis 84. The sear axis 47, however, can be laterally offset to a first lateral side 89 of that axis. Likewise, the sear engagement surface 54 engages the pawl engagement surface 66 to a first lateral side 89 of the tether force axis 84. Optionally, although now shown, the bowstring force axis 104 can be aligned with and parallel to the tether force axis 84, provided this alignment does not create any unbalanced forces that cause the sear engagement edge 54 to disengage the pawl engagement surface 66, thereby transitioning the release from the cocked mode to a firing mode. The bowstring force 103 is exerted on the sear 50 through the bowstring notch 52. This force exerted on the sear is translated through the sear axis 47 and the respective sear axle 42, through the release bracket 40 to the pawl pin 46 and respective pawl axis 44. As shown in FIG. 3, the sear axis 47 is offset laterally to the first lateral side 89 of the tether force axis 84.

III. Operation

The operation of the archery release will now be described in more detail with reference to FIGS. 3-5. The release 10 is initially placed adjacent a bowstring 100 so that the bowstring rests in the bowstring notch 52. The archer ensures that the sear engagement surface 54 engages the pawl engagement surface 66 by slightly rotating the handle 22 forward, generally away from the wrist strap and/or toward a bow. The archer then exerts a force through the strap which is translated though the tether 80 in the form of a tether force 83 that is exerted along the tether force axis 84. The archer pulls the release body 20 with an increasing drawing force through the wrist strap that translates through the tether to the release body 20 in the form of the tether force 83. The tether force overcomes, and is greater than, the bowstring force 103 so that the bowstring 100 is drawn. The archer continues to draw the bowstring 100 to a drawn state with the release 10.

During the drawing of the release, the release remains in a cocked mode, with the primary forces exerted on the release 10 being that of the bowstring force 103 and the tether force 83. The user need not contact the handle 22 or other portions of the release 10 to ensure that the release remains in this cocked mode. Generally speaking, the release "automatically" remains in this cocked mode with the sear engagement edge 54 remaining in contact with and engaging the pawl engagement surface 66 so that the sear 50 and/or release bracket 40 does not release the bowstring 100 from the bowstring notch.

As shown in FIG. 3, the release 10 is in its cocked mode and is being used to either draw the bowstring 100, or hold the bowstring in its fully drawn state. In the cocked mode in the fully drawn state, the bowstring force 103 generally balances the tether force 83. The tether force 83 used to hold the bowstring through the wrist strap 90 generally equals the bowstring force 103 exerted by the bowstring 100 so that the two are held in equilibrium, and the bow is maintained in its fully drawn state. Usually, in the fully drawn state, the archer is steadying the bow, and readying the bowstring 100 to be released by the release 10 upon perfecting their aim.

In the cocked mode, the bowstring force axis 104 can be generally offset laterally from the tether force axis 84. For example, the bowstring force axis 104 can be laterally offset to the first lateral side 89 of the tether force axis 84. Put another way, when viewed from the view of a right-handed archer drawing a bow, the tether force 84 can be laterally offset to the left of the bowstring force axis 104. Put yet another way, the bowstring force axis 104 can be laterally offset to the right 89 of the tether force axis 84 when in the illustrated cocked mode. Due to the geometric configuration of this lateral offset, or generally where the tethered and bowstring forces are balanced (even if the bowstring force axis 104 and tether force axis 84 are not laterally offset from one another, that is, they align with one another), the sear engagement edge 54 remains in engagement with the pawl engagement surface 66. Thus, the bowstring force and tether forces remain in equilibrium and the release remains static, and unable to release the bowstring from the bowstring notch. When in this cocked mode as well, the bowstring force 103 exerts a force component through the sear engagement edge 54 to be pawl engagement surface 66. Generally, this force component is countered with an equal force component through the pawl 60 from the tether force 83. With those two force components balanced in the cocked mode, the edge 54 and surface 66 remain engaged and immobile relative to one another in the cocked mode. Generally, the edge 54 and the surface 66 engage one another to the first lateral side 89 of the tether axis 84. In this way, the engagement forces between these components can be laterally offset from the tether force axis 84.

To actuate the release and thereby release the bowstring 100 to shoot the bow to which the bowstring 100 is attached, a user begins a firing sequence. As shown in FIG. 4, this firing sequence includes an action in which the release body 20 is rotated about the roller axis 72, or more generally, where the roller 70 and release body 20 are rotated relative to one another. To effectuate this rotation, a back tension force BTF is exerted on the handle 22. Generally, this BTF can be exerted by an archer's digits engaging the recesses 26 of the handle 22. The user can provide the movement of the handle 22 by generally depressing or moving the handle 26 toward to the wrist strap 90. Upon such engagement and movement, the release body 20 rotates in the direction of the arrow R1 about the roller axis 72. As the body 20 rotates about the roller axis 72 in direction R1, it optionally can simultaneously rotate in direction R2 about the pawl axis 44. This movement in turn causes the moon pawl 60 (which can be fixedly and non-rotatably attached to the release body 20 via the pin 44 and perhaps a set screw as described above) to rotate and move, also generally in direction of rotation R2. As a result, the pawl engagement surface 66 moves relative to the sear engagement edge 54, generally with the sear engagement edge 54 remaining substantially stable. Continued movement of the pawl 60 causes the sear engagement edge 54 to begin to disengage the pawl engagement surface 66 as shown in FIG. 4, and described further below.

As shown in FIG. 4, when the release body 20 rotates in direction R1 about the roller axis 72, the roller 70 can be pushed laterally to the "left," when viewed by a right-handed archer drawing the bowstring. Put another way, the tether force axis 84 moves laterally toward the second lateral side 89, generally away from the pawl axis 44. As the back tension force BTF is exerted to rotate the release body 20 about the roller axis 72, the tether force axis 84 also moves relative to the bowstring force axis 104. For example, as shown in FIG. 4, the tether force axis 84 begins to laterally diverge by an amount LD1 from the bowstring force axis 104. This can cause the tether force axis to both increase in distance from the bowstring force axis and/or increase the angle between the bowstring force axis 104 and tether force axis 84.

Figure 5:
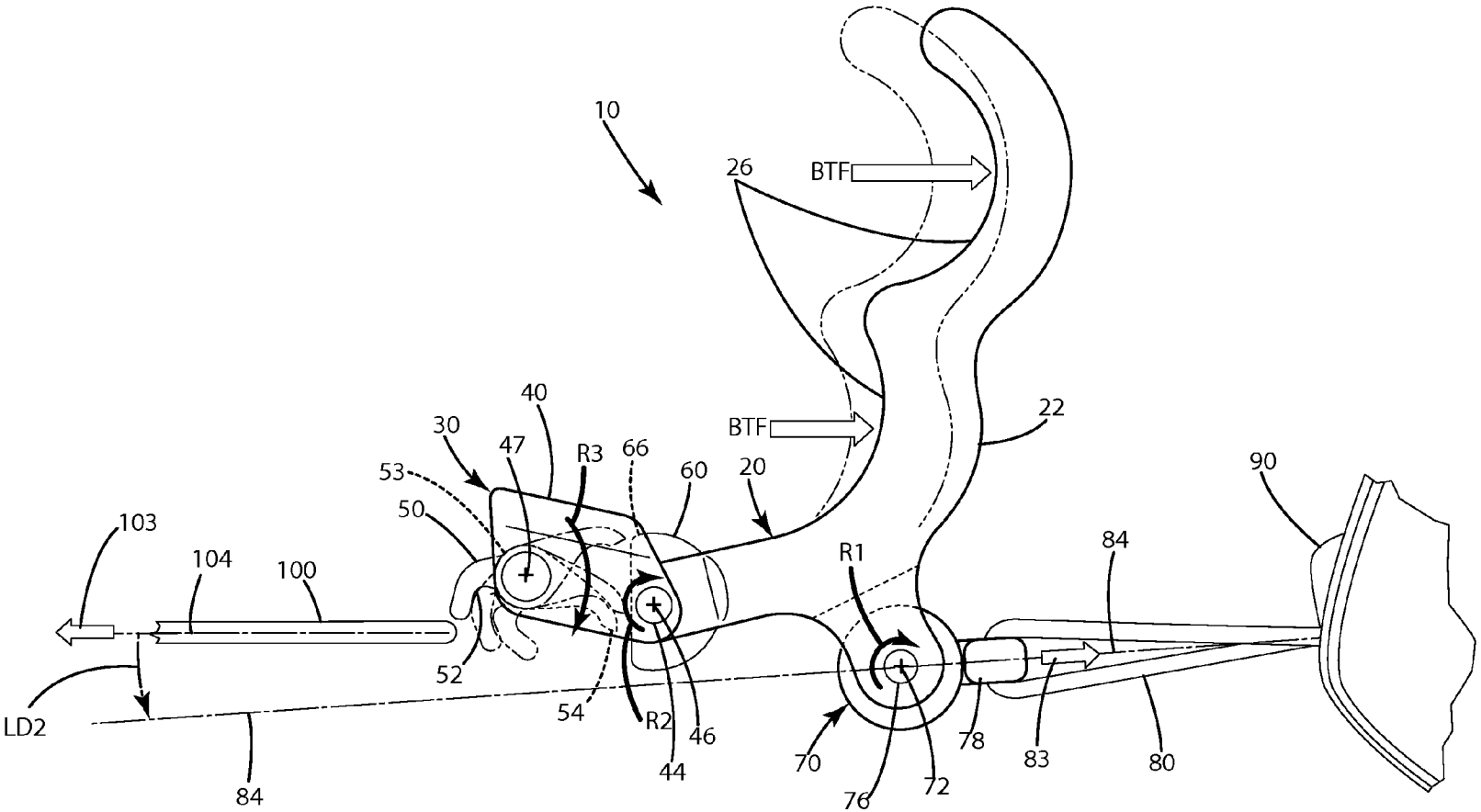
FIG. 5 is a top view of the release in a firing or releasing mode.
Figure 6:
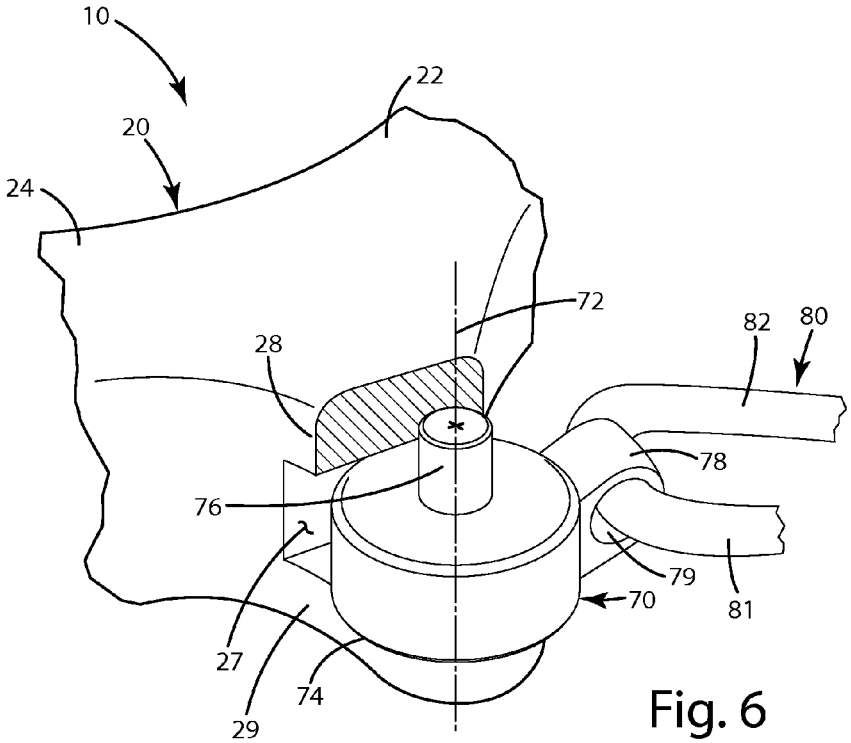
FIG. 6 is a partially broken view of a roller of the release.

As release body 20 is further rotated about the roller axis as shown in FIG. 5, the tether force axis 84 can move further relative to the bowstring force axis 104. As shown there, the tether force axis 84 laterally diverges by an amount LD2, which can be greater than LD1 from the bowstring force axis 104. This as well can cause the tether force axis 84 to both increase in distance from the bowstring force axis 104 and/or increase the angle between the bowstring force axis 104 and the tether force axis 84.

Movement of the release body 20 and the general rotation of the release body 20 about the roller axis 72 also can cause the roller axis 72 and pawl axis 46 to move from an aligned condition, where the two axes and respective axles are aligned along the tether (FIG. 3) to a misaligned configuration, where the roller axis 72 remains generally aligned and on the tether force axis 84, but the pawl axis 46 laterally diverges or becomes laterally offset from the tether force axis 84 (FIG. 5).

Generally, the movement of the release body 20 and the related causes the movement of the pawl 60 relative to the sear 50, which ultimately translates to the sear engagement edge 54 moving toward a position where it disengages the pawl engagement surface 66 of the pawl. Also, as the release body moves about the axis 72, the release body rotates relative to the roller 70 and/or the tether 80. The release body 20 also can rotate itself and the pawl 60 relative to the release head 40 and/or the bowstring 100.

As shown in FIG. 5, the back tension force BTF exerted on the handle 22 is great enough to have rotated the release body 20 sufficiently in direction R1 about the roller axis 72 so that the sear 50 disengages the pawl 60. As shown there, the release body 20 and the attached pawl 60 have been rotated in direction R2 relative to the release bracket 40 to such degree that the sear engagement edge 54 clears the boundary of the pawl engagement surface 66, thereby enabling the sear 50 to rotate freely in direction R3 about the sear axis 47. This, in turn, causes the bowstring notch 52 to move to disengage the bowstring 100.

As noted above, the bowstring 100 exerts a bowstring force 103 along the bowstring force axis 104. This bowstring force 103 is disengaged from the tether force 84 by virtue of the sear engagement edge 54 no longer being engaged with the pawl engagement surface 66. Accordingly, the bowstring force 103 rapidly rotates the sear 50 about the sear axis 47 in direction R3. Upon this rotation, the sear 50 is moved out of the way sufficiently so that the bowstring 100 exits the bowstring notch 52, enabling the bowstring to be fully released by the release 10, which itself is in the fully completed firing mode. To re-use the release and the shoot the bow again, a user repeats the above process.

IV. Alternative Embodiments

Figure 7:
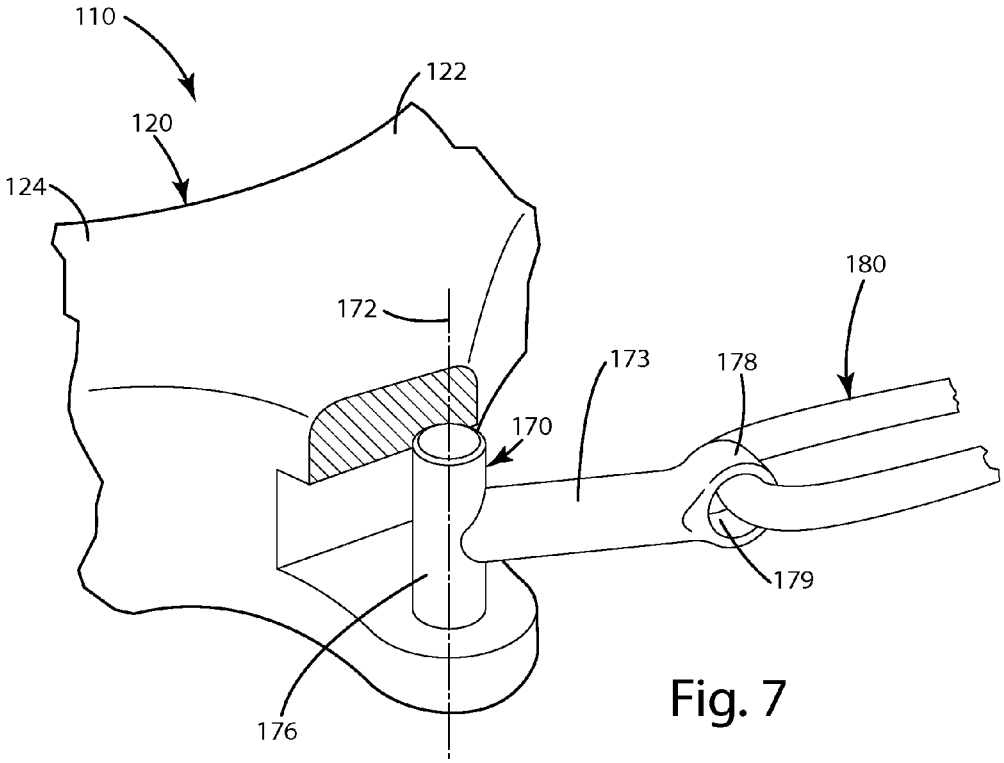
FIG. 7 is a partially broken view of a first alternative roller of the release.

The roller used with the release can come in a variety of a different constructions. As shown in FIGS. 1-6, the roller 70 generally includes a release body 74 including an attachment element 78. The roller 70 is mounted to the release body 20 via the release roller arms 28 and 29 and an axle 76. This construction, however, can be substituted with a variety of other roller constructions, all of which are equally considered rollers as that term is used herein. For example, as shown in FIG. 7, a first alternative roller construction includes a T-shaped roller 170. This T-shaped roller includes an axle 176 from which a bar 173 extends. The bar 173 can terminate at an attachment element 178 defining an attachment element hole 179 through which the tether 80 attaches. Like the embodiment above, the roller 170 can rotate relative to the body 120, and vice versa, about the roller axis 172. Optionally, if desired, in a slightly different configuration, the bar 173 can extend and be joined with the wrist strap 90, with the tether 80 being absent from the release.

Figure 8:
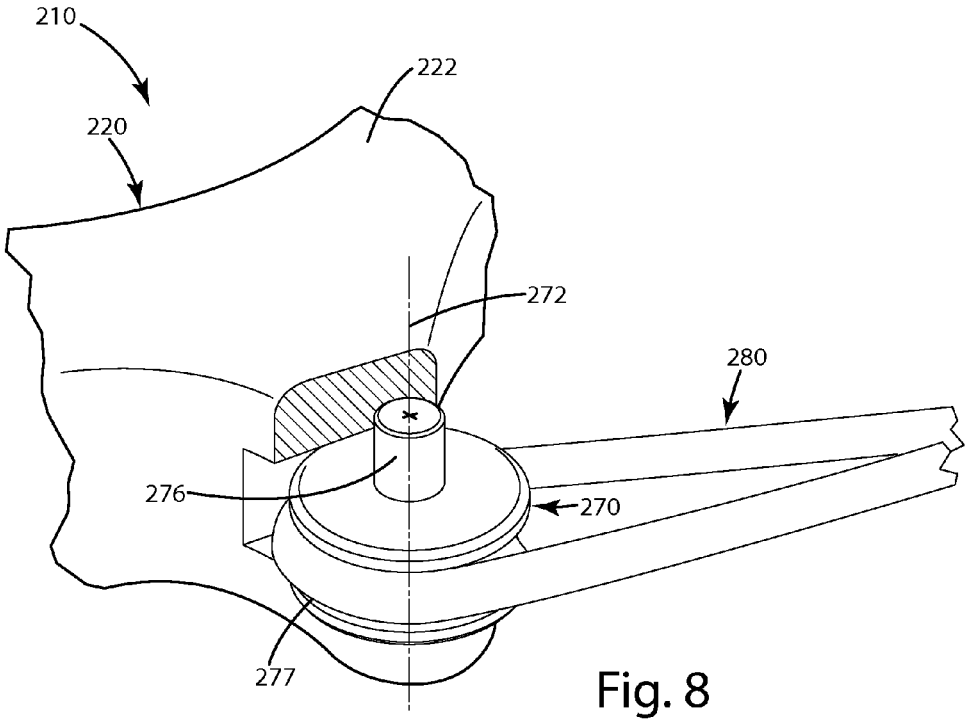
FIG. 8 is a partially broken view of a second alternative roller of the release.

As another example of an alternative roller, in FIG. 8, the roller 270 can define a groove 277 and can be rotatably mounted to a body 220 via an axle 276. The roller 270 can rotate relative to the body 220 about the axis 272 and vice versa. The groove can accommodate a portion of the tether 80 therein to join the tether with the strap 90.

Figure 9:
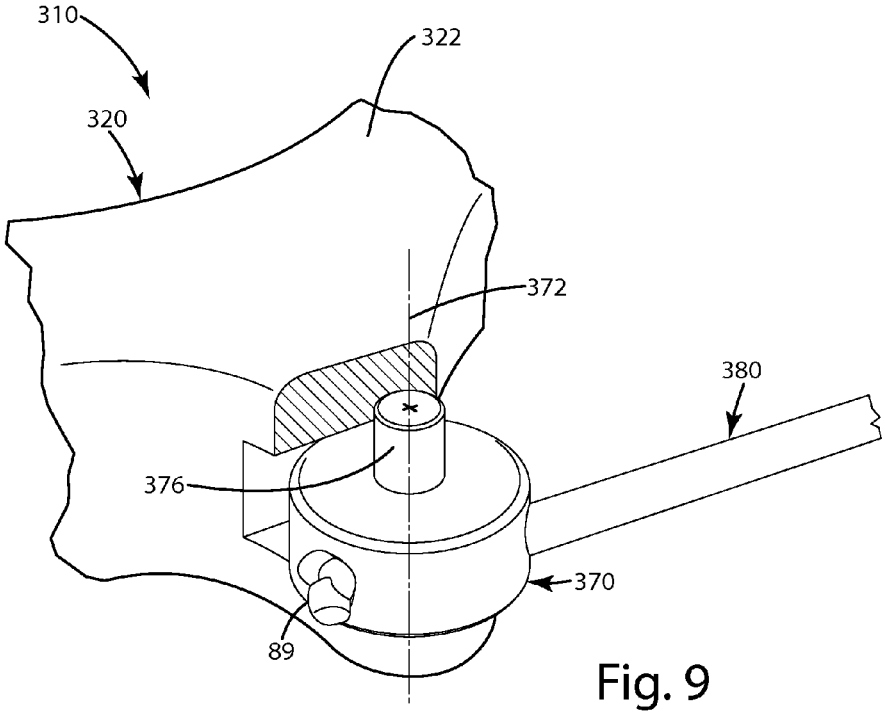
FIG. 9 is an exploded and broken view of a third alternative roller of the release.

FIG. 9 illustrates another alternative roller. There, the roller 370 defines a cross drilled or preformed bore 376. The roller 370 is mounted to the body 320 via an axle 376. The roller 370 is rotatable relative to the body 320 via an axis 372 and vice versa. A portion of the tether 80 can be positioned through the bore 376 and secured relative to the roller 370. For example, an end of the tether 80 can be tied in a knot 89 which can prevent the tether becoming disengaged from the roller 370. Alternatively, the other end of the tether 80 can loop back to the strap 90 (not shown). A variety of other roller constructions can be substituted for those noted above and enable the release body to rotate so that the respective tether force axis can be manipulated and reoriented relative to a bowstring force axis as described above.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A hybrid back tension archery release comprising:
- a back tension release body including a handle and an arm;
- a pawl pivotally joined with the arm;
- a sear including a bowstring notch and a sear engagement edge, the sear engagement edge adapted to selectively engage the pawl;
- a roller pivotally joined with the back tension release body, the back tension release body selectively rotatable about a roller axis when the handle is engaged by an archer;
- a wrist strap; and
- a flexible tether joined with the roller and extending to the wrist strap, the flexible tether joining the back tension release body and the wrist strap.

2. The hybrid back tension archery release of claim 1 wherein the roller includes an attachment element, wherein the flexible tether is joined with the roller via the attachment element.

3. The hybrid back tension archery release of claim 2 wherein the attachment element is in the form of an aperture, wherein the flexible tether is placed at least partially through the aperture.

4. The hybrid back tension archery release of claim 1 wherein the tether exerts a tether force on the roller along a tether force axis, wherein the sear is adapted to consistently position the bowstring notch laterally offset from the tether force axis so that a bowstring force, exerted by a bowstring within the bowstring notch when the bowstring is drawn, retains the sear engagement edge in selective engagement with the pawl so that the bowstring notch does not disengage the bowstring to release the bowstring.

5. The hybrid back tension archery release of claim 4 wherein the bowstring force is exerted by the bowstring along a bowstring force axis, wherein the tether force axis and the bowstring force axis are at least one of laterally offset from one another and balanced with one another.

6. The hybrid back tension archery release of claim 1 comprising a release bracket, the release bracket pivotally joined with the back tension release body and selectively rotatable about a pawl axis, wherein the tether exerts a tether force on the roller along a tether force axis, wherein the pawl axis is aligned along the tether force axis when a bowstring within the bowstring notch is drawn.

7. The hybrid back tension archery release of claim 1 wherein the tether exerts a tether force along a tether force axis, wherein a bowstring within the bowstring notch exerts a bowstring force along a bowstring force axis when the bowstring is drawn, wherein the bowstring force is laterally offset from the tether force when the bowstring is drawn so that the sear engagement edge is forced to engage the pawl when the bowstring is drawn.

8. The hybrid back tension archery release of claim 1 wherein the release body is selectively rotatable about the roller axis when the handle is depressed so that the sear engagement edge disengages the pawl thereby causing the bowstring to be released from the bowstring notch.

9. The hybrid back tension archery release of claim 1 wherein the sear and the pawl pivot in synchronicity when the release is in a tensioned state and the sear and the pawl pivot independently when the release is in an un-tensioned state.

10. A hybrid back tension archery release comprising:
- a back tension release body including a handle;
- a roller pivotally joined with the back tension release body, the roller defining a roller axis;
- a pawl pivotally joined with the back tension release body;
- a wrist strap;
- a sear defining a bowstring notch joined with the back tension release body, wherein the sear is adapted to automatically engage the pawl when a bowstring in the bowstring notch is initially drawn, wherein the sear is adapted to disengage the bowstring notch from the bowstring when the handle is engaged by an archer so as to rotate the back tension release body about the roller axis; and
- a tether joined with the roller and extending to the wrist strap, the tether joining the back tension release body and the wrist strap;

wherein the release body is adapted to selectively rotate about the roller axis when the handle is engaged by the archer, whereby the release is configured to release a bowstring held thereby upon such selective rotation of the back tension release body.

11. The hybrid back tension archery release of claim 10 wherein the selective rotation of the back tension release body about the roller axis disengages the sear from the pawl when the handle is depressed by the archer.

12. The hybrid back tension archery release of claim 10 comprising a tether force axis and a bowstring force axis, the tether force axis offset laterally from the bowstring force axis when a bowstring is drawn with the release so that the release remains in a cocked mode as the bowstring is drawn.

13. The hybrid back tension archery release of claim 12 wherein the release is adapted to transition to a firing mode, in which the bowstring is released, by rotating the back tension release body about the roller axis when the archer moves the handle toward the wrist strap.

14. The hybrid back tension release of claim 12 wherein the handle includes at least one finger recess located to a first lateral side of the tether force axis, and no finger recesses located to an opposing second lateral side of the tether force axis.

15. The hybrid back tension archery release of claim 10 comprising a roller axle joined with the back tension release body, the roller being rotatable about the roller axle, the roller axle being coincident with the roller axis.

16. The hybrid back tension archery release of claim 10 comprising:

the pawl pivotally joined to the back tension release body with a pawl axle;

the sear including a sear engagement edge, the sear rotatably joined with a sear axle; and a release bracket joined with the pawl axle and the sear axle.

17. An archery release comprising:

a release body pivotally joined with a roller defining a roller axis;

a wrist strap;

a tether extending between and joining the roller with the wrist strap, wherein the release body is configured to rotate about the roller axis when the release is transitioned from a cocked mode to a firing mode;

wherein the release body comprises:

a pawl pivotally joined with an arm;

a sear including a bowstring notch and a sear engagement edge, the sear engagement edge adapted to selectively engage the pawl.

18. The hybrid back tension archery release of claim 17 comprising a tether force axis and a bowstring force axis, the roller adapted to laterally diverge the tether force axis from the bowstring force axis when the release body is moved.

* * * * *